United States Patent [19]

Maüs et al.

[11] 4,135,420

[45] Jan. 23, 1979

[54] DEVICES FOR SEVERING STRIPS

[75] Inventors: Dieter Maüs, Neuffen; Hermann Buck, Huelben, both of Fed. Rep. of Germany

[73] Assignee: Bielomatik Leuze & Co., Fed. Rep. of Germany

[21] Appl. No.: 805,047

[22] Filed: Jun. 9, 1977

[30] Foreign Application Priority Data

Jun. 25, 1976 [DE] Fed. Rep. of Germany ..... 2628536

[51] Int. Cl.[2] ..... B26D 1/38; B26D 1/56; B26D 5/38

[52] U.S. Cl. ..... 83/371; 83/292

[58] Field of Search ..... 83/360, 369, 370, 371, 83/372, 349, 290, 292, 293

[56] References Cited

U.S. PATENT DOCUMENTS

| | | | |
|---|---|---|---|
| 2,211,362 | 8/1940 | Bennett | 83/370 X |
| 2,855,995 | 10/1958 | Jacobsen | 83/370 |
| 3,776,078 | 12/1973 | Perlman | 83/371 X |

FOREIGN PATENT DOCUMENTS

| | | | |
|---|---|---|---|
| 1105882 | 5/1961 | Fed. Rep. of Germany | 83/371 |

*Primary Examiner*—Willie G. Abercrombie

*Attorney, Agent, or Firm*—J. Rodman Steele, Jr

[57] ABSTRACT

The present specification describes and claims a device for severing a strip which interconnects items conveyed one behind the other and spaced apart from each other. The device is particularly suited to cutting the binding strip for the spine of books, blocks etc. The device comprises a knife mechanically coupled to a follower device which, in use, follows the profile of the individual items. The follower device maintains the knife in a position ready to cut and when the follower device drops down a gap between adjacent items, the movement of the knife activates control means to operate a knife power drive, the knife then cutting the strip and following a working cycle back to a ready position wherein the follower device can engage a subsequent item.

13 Claims, 3 Drawing Figures

DEVICES FOR SEVERING STRIPS

Figure 1:
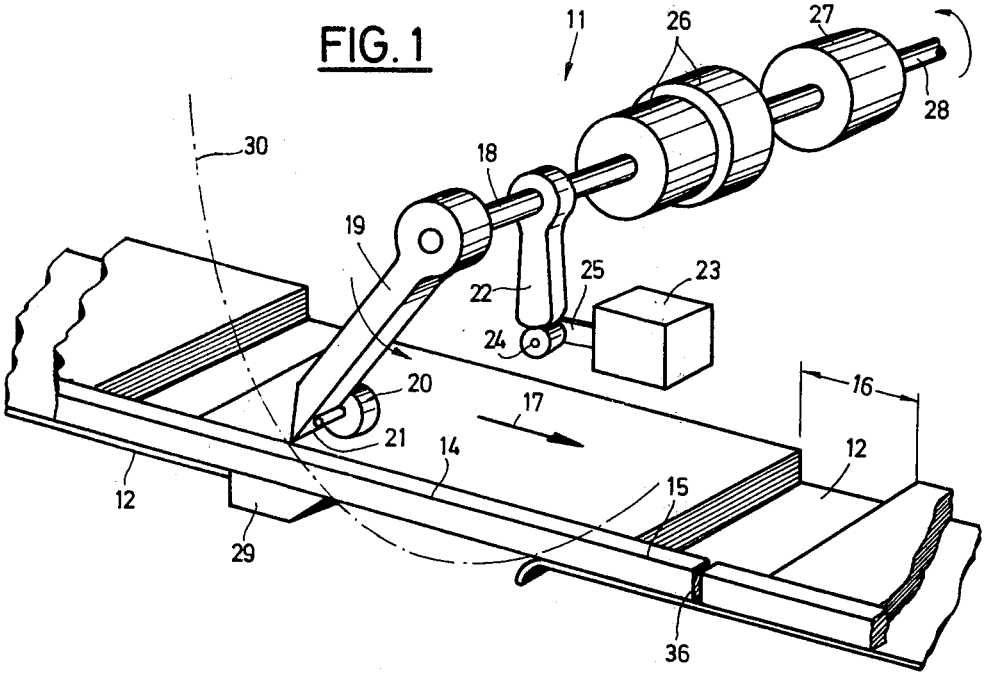

The present invention relates to a device for severing a strip which interconnects items conveyed one behind the other and spaced apart from each other, particularly, a binding strip for the spines of books, blocks or the like, which device has a knife and a mechanical follower device which controls the knife and follows the profile of the individual items.

Devices of this type are used in machines for producing stitched stacks of sheets, such as check books, notepads or the like, in which the stitched spines are surrounded in a U-shaped manner by means of a binding strip which is also designated "slip-fold" strip. The individual stacks of sheets or blocks, when on their conveying path, are spaced apart at a distance which, however, is bridged by the binding strip, since the latter is fed and glued to the spines in an endless manner. In order that the stacks of sheets can be fed individually for further processing, for example to a side trimming device, the blocks have to be separated from one another by severing the slip-fold strip somewhere between one block and the other block.

Devices of the type mentioned initially, and which have already been proposed, operate with a perpendicularly guided guillotine actuated by a mechanical sensing device. The sensing device operates independently of the knife. Since the guillotine operates at right angles to the direction of movement of the blocks and its speed is limited owing to its oscillating movement, work has to be carried out with a relatively great distance between the individual stacks of sheets if it is desired to increase the rate at which the stacks of sheets are conveyed. This not only impairs the utilization of the machine, but also leads to an unnecessary consumption of binding strip. Furthermore, the device is of complicated construction and is subjected to a considerable amount of wear.

Furthermore, it is known from German Offenlegungsschrift No. 2,120,240 to sever a normal smooth web of paper or foil in a controlled manner. For this purpose, marks are provided on the web and control a transverse cutter by way of an optical sensing device. The known arrangement operates the transverse cutter purely electrically when the marks are sensed.

An aim of the present invention is to provide a device of the type mentioned initially by means of which, despite simple construction, a large number of working cycles can be obtained with great reliability and freedom from trouble with only a short distance between the individual items e.g. stacks of sheets.

According to the present invention there is provided a device for severing a strip which interconnects blocks or stacks of sheets conveyed one behind the other and spaced apart from each other, particularly a binding strip for the spine of books, blocks or the like, said device comprising a follower device for following the profile of the blocks or stacks of sheets, the follower device being mechanically coupled to a knife and arranged to maintain the knife in front of a cutting position, and control means for controlling a knife drive in dependence upon the movement of the knife.

In a particularly preferred embodiment of the present invention, the knife is arranged on a rotatable knife shaft. Preferably, the follower device is a roller which runs, for example, on the stacks of sheets and which is mounted on the knife or its carrier.

By virtue of the present invention, a cutting device is provided which has a control which acts directly and also indirectly. By virtue of the roller connected to the knife and running directly on the stack of sheets, the knife is reliably prevented from prematurely engaging the stack of sheets. Nevertheless, the knife can be already located directly in front of a cutting location, so that it cuts immediately after the end of the stack of sheets. The power drive of the knife is switched on by the control means at the instant at which the roller drops from the stack of sheets, and the knife passes forcibly through the strip under the action of the power drive, and is actuated for a working cycle. The knife is subsequently braked by switching off the power drive, optionally also with the applying of a brake, and is held in a fresh waiting position with the roller engaging or ready to engage a subsequent stack of sheets.

A cutting device according to the present invention may alternatively be constructed in the form of a transversely operating guillotine, although the aforesaid preferred embodiment having a rotating knife is substantially more advantageous and renders it possible to obtain higher cutting rates with smaller structural expense and less wear. It is particularly advantageous if the knife runs in the conveying direction and its speed thus substantially corresponds to the speed at which the stacks of sheets are conveyed. However, this can be varied within a relatively wide range. If the speed of the stacks of sheets should be higher, the next stack of sheets can carry the knife along without causing trouble if a freewheel device is incorporated in the drive for the knife. In any case, however, one obtains the advantage that the gaps between the stacks of sheet can be kept particularly small as a result of the following knife.

The present invention will now be further described, by way of example, with reference to the accompanying drawings, in which:-

Figure 2:
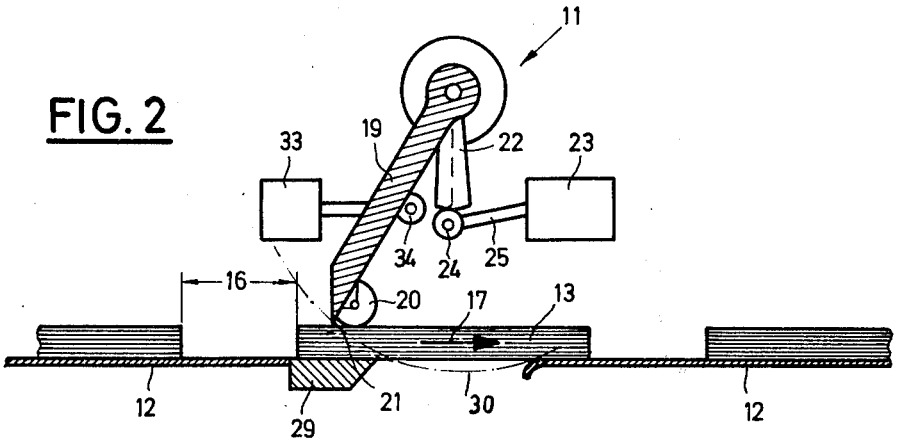
Figure 3:
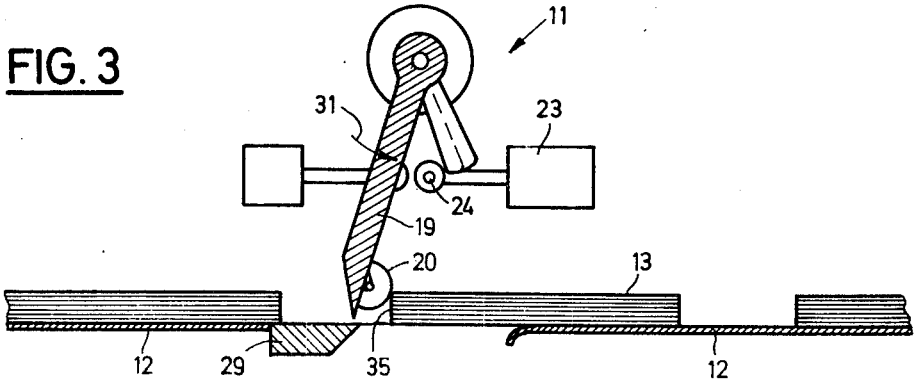

FIG. 1 is a perspective, diagrammatic illustration of one embodiment of a device constructed according to the present invention; and FIGS. 2 and 3 show, diagrammatically, two side views of the two different working positions of the device of FIG. 1, sectioned in a vertical plane through the knife.

The drawings show a cutting device 11 arranged in the region of a conveying path 12 for stacks 13 of sheets. As is illustrated, the conveying path 12 can comprise a conveyer table on which the stacks 13 of sheets, spaced at a distance 16 apart, are moved by conveying mechanisms (not illustrated). However, it is also possible to convey the stacks of sheets on conveyor belts or the like.

The spines 14 of the stacks of sheets are stitched by, for example, wire-stitching and are surrounded in a U-shaped manner by a binding strip 15 made from paper or textile material. Since the binding strip 15 is fed in an endless manner and is glued to the spine or to the top and bottom sheets of the stack adjacent to the spine, the binding strip also extends across the distance 16 and thus interconnects the individual stacks 13 of sheets.

A knife 19 is mounted above the conveying path 12 on a shaft 18 which extends transversely of the conveying direction 17 and which is journalled in a machine frame (not illustrated). A rotatably mounted roller 20 is mechanically connected to the knife, to the knife itself in the illustrated embodiment, and, as may be seen particularly in FIG. 2, rests on the top of the stack 13 of sheets and runs along the latter. The cutting edge 21 of the knife 19 is then reliably fixed at only a short distance above the top sheet of the stack 13 of sheets. When in this position, the knife slopes at an angle in the opposite direction to the conveying direction 17.

A cam 22 is rigidly mounted on the knife shaft 18 and co-operates with a control device 23. In the illustrated embodiment, the control device is a switch which is normally open and, when in the positions shown in FIG. 1 and 2, is switched off by the cam 22 by virtue of the fact that the cam 22 co-operates with a roller 24 on the actuating arm 25 of the control device 23 and urges the switch downwardly to switch off the latter.

Furthermore, an electro-magnetic clutch 26 is shown diagrammatically in FIG. 1 and can be engaged and disengaged by means of the control device. The end of the clutch 26 on the drive side is connected by way of a free-wheel device 27 to a drive shaft 28 which is driven preferably by the common drive of the machine in synchronism with the conveying of the stacks of sheets. However, it is also possible to drive the drive shaft 28 by means of an independent motor.

The knife 19 co-operates with a bottom knife 29 which is arranged on a level with the conveying path 12 and whose cutting edge is located in the path 30 (shown by a dash-dot line) of the cutting edge 21 of the knife 19. The direction 31 of rotation of the knife 19 is such that the cutting edge 21 of the knife 19 moves substantially in the conveying direction 12 in the region of the cutting position. Preferably, the peripheral velocity of the cutting edge 21 can be of the same order of magnitude as the speed at which the stacks 13 of sheets are conveyed.

A further control device 33 is provided in FIGS. 2 and 3 in addition to the control device 23 and also comprises a switch which, however, is normally open and which is closed by depressing its roller 34 on the actuating arm by means of the cam 22 formed with a somewhat longer circumferential portion. The control device 33 actuates a brake (not illustrated) on the knife shaft 18. The control devices 23 and 33 co-operates electrically with electro-magnetic clutches or electro-magnetic brakes. Alternatively, however, the clutch and/or the brake can be actuated mechanically.

The illustrated device operates as follows:

The knife 19 is illustrated in its normal position in FIGS. 1 and 2, i.e., when the stacks 13 of sheets are running in the conveying direction 17 on the conveyor path 12, with the roller 20 resting on a particular stack 13 of sheets located below the knife, the roller 20 thus maintaining the cutting edge 21 at a distance from this stack of sheets. The clutch 26 is released when the roller 24 of the control device is depressed by means of the cam 22. The brake (not illustrated) is also released, since the roller 34 is located in its non-actuated position.

FIG. 3 shows the position of the knife 19 shortly before the knife effects a cutting operation. The roller 20 has reached the edge 35 of the stack 13 of sheets trailing in the conveying direction and is located in the gap between two stacks of sheets, i.e. it has "dropped into" the space 16. The knife has thereby turned slightly in an anti-clockwise direction relative to the position shown in FIG. 2. The control cam 22 mounted on the knife shaft has thus released the roller 24 of the control device 23, so that the switch incorporated in the control device has been closed and the electro-magnetic clutch 26 establishes a driving connection between the knife shaft and the drive shaft 28 which is permanently rotating in an anti-clockwise direction. The knife is thus rotated in an anti-clockwise direction and effects a cutting operation between its cutting edge 21 and the bottom knife 29. The knife then swings further in an anti-clockwise direction until it again located shortly in front of the position shown in FIGS. 1 and 2. In the embodiment of FIG. 1, i.e. the embodiment without a brake, the roller 24 of the control device 23 is depressed again shortly before the knife reaches its readiness position shown in FIG. 2, whereby the clutch 26 opens and the knife is then supported on the stack of sheets by means of the roller 20. However, the brake indicated in FIGS. 2 and 3 is advantageous for maximum protection of the stack of sheets in an embodiment for higher circumferential speeds. The brake is actuated by depressing the roller 34 of the control device 33, although the cam 22 is designed such that, upon the commencement of the braking operation, the clutch 26 is disengaged by depressing the roller 24 of the control device 23. The knife is then braked before the roller 20 reaches the stack of sheets. The illustrations of FIGS. 2 and 3 are only diagrammatic illustrations. It is also possible to actuate the brake by means of the control device 23 in a time-controlled manner, i.e. the knife shaft 18 is first automatically braked for a short period of time whenever the clutch is disengaged.

Furthermore, it is advantageous if the clutch 26 transmits to the knife shaft 18 a certain amount of torque, if only a small amount of torque, even when the clutch is in its disengaged state. Thus, the "dropping-in" of the roller 20 into the space 16 is accelerated and thus the starting of the knife shaft which is otherwise effected by gravity.

Since the cutting edge 21 of the knife 19 follows the conveying movement 17, the spaces between the individual stacks of sheets can be relatively short. The free-wheel device 27 ensures that, when the speed at which the stacks of sheets are conveyed is greater than the rotational speed of the knife 19, the next stack of sheets can push the knife 19 along without being obstructed by the mechanism. The knife can thus override its drive. Thus, the knife does not come out of synchronism, since, in any case, it has a certain dwell time in the position shown in FIG. 2. Thus, the rotational speed of the knife 19 is dimensioned such that the rotation of the knife is always concluded before the trailing edge 35 of the next stack of sheets again reaches the roller 20.

Thus, by virtue of the invention, it is possible to sever (portion 36 in FIG. 1) the binding strip 15 even when there is only a very short distance 16 between the stacks 13 of sheets. The controlled drive of the knife 19 with sensing by way of a roller or a similar element on the knife shaft provides both reliable control and a mechanical protection against malfunction. In other words, the knife can never strike into the block and thus put the entire machine out of operation. The controlled driving connection thus provides for a very satisfactory operation of the knife. A large number of modifications of the illustrated and described embodiment are possible within the scope of the invention. Thus, for example, the follower device 20 may comprise a sliding element instead of a roller and does not have to be directly mounted on the knife, provided that a driving connection exists between the sliding element and the knife. The control device 23 can also be actuated other than by means of cams, for example by electrical or optical signals. In addition to the illustrated use for the severing of a binding strip for stacks of sheets, the device in accordance with the invention is also advantageous for severing other strips which project beyond block-like articles or interconnect them.

We claim:

1. A device for severing a strip which interconnects items conveyed one behind the other and spaced apart from each other, particularly a binding strip for the spine of books, blocks or the like, said device comprising:

a follower device for following the profile of the items;

a knife, the follower device mounted for movement together with the knife, the follower device being arranged to maintain the knife in a first position, under a force urging the knife towards a cutting position;

an externally energized knife drive for powerfully moving the knife through the cutting position; and, switching means for the knife drive, actuated by an initial movement of the knife due to the follower device detecting a gap between adjacent items.

2. A device according to claim 1, wherein a rotatable knife shaft supports the knife.

3. A device according to claim 1, wherein a roller which, in use, runs on the blocks or stacks of sheets forms said follower device.

4. A device according to claim 3, wherein the roller is mounted on the knife.

5. A device according to claim 3, wherein the roller is mounted on a support for the knife.

6. A device according to claim 2, wherein an electrical switch operable by means of a cam on the knife shaft forms said control means.

7. A device according to claim 1, wherein a clutch operable by the control means is included in the knife drive.

8. A device according to claim 7, wherein a free-wheel device is included in the knife drive.

9. A device according to claim 1, further comprising means for maintaining a force in the cutting direction even when the follower device is following the profile of an item.

10. A device according to claim 1, further comprising means for maintaining a torque in the cutting direction even when the follower device is following the profile of an item.

11. A device according to claim 2, wherein a control device operable by the knife drive is provided for braking the knife drive.

12. A device according to claim 2, wherein the knife is arranged to move in the conveying direction of the items in the region of a cutting location.

13. A device according to claim 12, wherein the circumferential speed of the cutting edge of the knife substantially corresponds to the speed at which the items are conveyed.

* * * * *